United States Patent [19]

Engle

[11] Patent Number: 4,690,393

[45] Date of Patent: Sep. 1, 1987

[54] APPARATUS FOR SEPARATING STACKS OF CLOTH

[75] Inventor: Elbert Engle, Ashville, Ala.

[73] Assignee: Chesebrough-Pond's, Inc., Conn.

[21] Appl. No.: 786,337

[22] Filed: Oct. 10, 1985

Related U.S. Application Data

[63] Continuation-in-part of Ser. No. 492,721, May 11, 1983, Pat. No. 4,555,102.

[51] Int. Cl.[4] ..... B65H 3/22

[52] U.S. Cl. ..... 271/4; 271/18.3; 271/97; 271/111; 271/155; 271/261; 271/263; 271/213

[58] Field of Search ..... 271/18.3, 95, 97, 98, 271/105, 110, 111, 261, 263, 147, 152–155, 901

[56] References Cited

U.S. PATENT DOCUMENTS

| | | | |
|---|---|---|---|
| 3,127,167 | 3/1964 | Rabinow | 271/95 |
| 3,182,301 | 5/1965 | Kolb | 271/263 X |
| 3,191,530 | 6/1965 | Fath | 271/261 X |
| 3,244,971 | 4/1976 | Thompson | 271/263 X |
| 3,595,562 | 7/1971 | Oldroyd | 271/98 |
| 3,595,567 | 7/1971 | Lee | 271/261 |
| 3,712,611 | 1/1973 | Jacquot | 271/95 X |
| 4,052,050 | 10/1977 | Carter | 271/18.3 |
| 4,127,266 | 11/1978 | Williams | 271/263 |
| 4,386,770 | 6/1983 | Hellin | 271/18.3 |

*Primary Examiner*—Richard A. Schacher
*Attorney, Agent, or Firm*—Brumbaugh, Graves, Donohue & Raymond

[57] ABSTRACT

A machine for separating single plies of fabric from a stack of fabric plies uses a roller provided with a fabric ply engaging mechanism. The roller engages the top ply of fabric and removes it with a rolling action. The engaging mechanism comprises a pivotable rod mounted on the roller and provided with protruding pins which engage the top ply of fabric from the stack as the rod is pivoted. The machine can be arranged to sort alternate plies of fabric from one stack into separate stacks. The machine can be provided with an adjustable support for holding the stack and with a detector for detecting the presence of a single fabric ply on the roller. The engaging mechanism is provided with a pair of pin holders whose spacing can be varied, the roller is provided with a plurality of rows of air holes to provide air flow to aid in separating a single ply from the stack, a detection arrangement is included which can detect folds in the single ply during its transport on the roller, and the adjustable support uses an improved arrangement for maintaining an essentially constant upward pressure by the stack against the roller during pickup despite changes in the size of stack as it is depleted by removal of the plies.

10 Claims, 25 Drawing Figures

STEP 1

STEP 2

STEP 3

STEP 4

STEP 1

STEP 2

STEP 3

STEP 4

APPARATUS FOR SEPARATING STACKS OF CLOTH

This is a continuation-in-part of my application Ser. No. 492,721 filed May 11, 1983 now U.S. Pat. No. 4,555,102 granted Nov. 26, 1985.

BACKGROUND OF THE INVENTION

This invention relates to clothing manufacturing and particularly to apparatus for automatically handling fabric.

Most clothing manufacturing is currently carried out using a large amount of manual labor. Prior attempts to automate clothing manufacturing have encountered difficulties with respect to handling single plies of cloth in the process of removing them from a stack of cloth having multiple plies. In one particular operation involving the manufacture of children's garments, such as striped T-shirts using knitted striped fabric, it becomes necessary to separate alternate layers of fabric plies from a stack of fabric plies. Knitted goods used in the manufacture of children's clothing are generally knitted in the form of a large diameter tube. When laid flat for cutting, this tube has two plies which have corresponding patterns, such as stripes, which run around the circumference of the knitted tube. In using such fabric tubes, a cutter cuts a pattern from a stack consisting of many plies of fabric tubes laid flat. The result is a stack of fabric plies which includes alternating layers corresponding to the fronts and backs of a garment. The general outline of the plies in the stack for the front pieces and the back pieces is identical. Since they are cut together from a tube, the front and back pieces match each other in the cloth pattern. The complete shaping of the garment, however, generally requires that the front pieces of the garment be cut at the neck to form a slightly different pattern. In order to cut the front pieces at the neck, it becomes necessary to separate alternating layers in a stack of fabric, and form two stacks corresponding to matching front and back pieces. The stacks which will form front pieces are cut again at the neck line. The corresponding fronts and backs are then combined in a sewing operation from the matching stacks so that the pattern of the knit material will match at the sides. This process of separating the front and back pieces from alternating layers of a stack of fabric plies has heretofore been done by hand, and requires considerable labor cost.

It is therefore an object of the present invention to provide apparatus which automatically handles single plies of cloth contained in a stack of fabric plies.

It is a further object of the present invention to provide an apparatus for detecting the presence of a single ply of material on a fabric transport apparatus.

It is a further object of the present invention to provide apparatus for maintaining the level of a stack of fabric plies in a material handling apparatus.

It is a still further object of the present invention to provide an apparatus for automatically sorting alternate layers of fabric plies contained in a stack of fabric plies and form two stacks therefrom.

It is a still further object of the present invention to provide an apparatus for continuously sorting alternate layers of fabric piles which is readily adjustable to handle piles of different widths.

SUMMARY OF THE INVENTION

In accordance with the present invention, there is provided an apparatus for removing a single ply of fabric from a stack of fabric plies. The apparatus includes a fabric ply transport mechanism arranged for relative motion with respect to the stack and arranged to engage the top fabric ply of the stack. There is also provided a fabric engaging mechanism mounted on and carried by the transport mechanism. The fabric engaging mechanism comprises an elongated rod mounted to the transport mechanism and pivotable with respect thereto about a longitudinal axis. It includes pins mounted to the rod and extending therefrom in a direction transverse to the rod axis. There are further provided means, interconnecting the rod and the transport mechanism for pivoting the rod about its axis to rotate the pins from a first orientation substantially perpendicular to the top of the stack when the transport mechanism engages the top of the stack, to a second orientation substantially parallel to the top of the stack, whereby the engaging mechanism engages the top fabric ply of the stack.

In a preferred embodiment, the elongated rod has at least two substantially flat surfaces intersecting each other and forming a longitudinal edge, and the pins extends from one of the flat surfaces. The rod engages the stack by the pin containing surface in the first orientation, and engages the stack by the other surface in the second orientation. Preferably the pins extends from the surface in close proximity to the edge and the rod axis is also in close proximity to the edge. The second surface may be provided with openings through when which gas may be emitted for a selected period following rotation of the engaging mechanism, thereby to push away the second fabric ply during the engagement process. The pins preferably extend from the rod by a distance which is less than the thickness of the fabric ply, preferably between about one-half the thickness and less than the full thickness.

Moreover, in my improved embodiment, the rod is provided with a pair of slots aligned apart in the axial direction. A row of pins are assembled in a common holder and a separate holder is supported within and slidable along each of the two slots in the rod whereby the full width of the rows of pins may be varied to accommodate different widths of fabric by varying the position of each holder in its slot.

In one embodiment, the transport mechanism comprises a roller arranged for rolling engagement motion over the stack of fabric plies and having an outer roller surface provided with a longitudinal opening. The elongated rod which engages the fabric is mounted in the longitudinal opening of the roller. The apparatus may include surfaces for holding the stack from which fabric plies are being removed and for adjusting the height of the stack as plies are removed from the stack. The entire operation of the apparatus may be controlled and cocordinated by a control mechanism, which in a preferred embodiment comprises a programmed microprocessor.

In my improved embodiment, each roller is provided with several longitudinal rows of air holes, the rows being circumferentially spaced around a portion of the roller. Associated with each row of holes is a separate valve for controlling the flow of air into the holes of that row. The opening of the valves is synchronized with the rotation of the roller to facilitate the separation of a single ply from the stack of piles as the roller rolls over the stack.

In accordance with the invention, there is provided an apparatus for detecting the presence of a fabric on a fabric transport mechanism which has a fabric supporting surface. The apparatus includes a magnetic field source and a magnetic field detector. The transport mechanism is arranged to move fabric between the magnetic field source and the magnetic field detector. Means are provided and coupled to the operation of the transport mechanism, for sampling the output of the magnetic field detector at a selected time during the operation, and for comparing the output to a threshold level thereby to detect the presence of a fabric. Preferably, the threshold level is between the output level of the magnetic field detector when there is no fabric on the transport mechanism and the output of the magnetic field detector when there is a single ply on the transport mechanism. There may also be provided a second threshold level which corresponds to a level between the output level of the detector corresponding to a single fabric ply and the output level corresponding to multiple fabric plies.

In my improved apparatus, the apparatus for detecting the presence of fabric on the transport mechanism is adapted for testing the magnetic field at two locations spaced apart in the axial direction of the cylindrical roller. If the two locations correspond to the two edges of the width of the ply, folds which narrow the width of the ply are readily detected. This ability is particularly important when the fabric is wide and so susceptible to fold problems. In this apparatus a pair of magnetic field sources and a pair of magnetic field detectors are employed appropriately located.

In accordance with the invention, there is provided apparatus, useable in a machine for operating on plies of fabric in a stack of fabric plies, wherein there is provided a fabric transport mechanism supported on a machine frame and periodically engaging the top of the stack. The apparatus is for adjusting the position of the stack with respect to the transport mechanism and includes a support for a stack which is mounted to the machine frame for vertical motion with respect to it. There is also provided a source of controlled fluid pressure and a cylinder connected to the fluid pressure source having a piston operated on by the fluid pressure. Means are provided interconnecting the cylinder, the piston, the support and the frame for urging the support in an upward direction with respect to the transport mechanism in response to the fluid pressure on the piston. There is also provided a controlled brake, arranged to prevent movement of the support with respect to the transport when engaged, and to permit movement of the support when disengaged. Control means are provided for operation in coordination with the transport mechanism for disengaging the brake when the transport mechanism engages the top of the stack and for engaging the brake when the transport mechanism is disengaged from the stack.

In the preferred embodiment a split arm support arrangement is used in which each arm changes the leverage it provides to support the stack as the weight of the stack changes. This serves to maintain the same pressure of the stack against the drum despite decreases in the weight of the stack as piles are removed.

In accordance with the invention there is provided an apparatus for separating alternate plies from a first stack of fabric plies into second and third separate stacks. The apparatus includes a frame and a first support mounted to the frame and having a first horizontal support platform for holding the first stack of fabric plies. The first support is arranged for vertical movement with respect to the frame. There is also provided a second support mounted to the frame and having second and third vertically separated horizontal support platforms for holding the second and third stacks of fabric, the second support being arranged for vertical movement with respect to the frame. First and second adjustment means are provided for adjusting the level of the first platform with respect to the frame and for adjusting the level of the second and third platforms with respect to the frame. There is provided a carriage on the frame for horizontal motion between positions corresponding to the first and second supports. A roller is provided, carried by the carriage and arranged for rotation with respect thereto in response to motion of said carriage at an angular rotation speed corresponding to approximately zero horizontal motion of the bottom sector of the roller. Engagement means are carried by the roller for engaging a top ply of fabric from the first stack. First transport means are provided for periodically moving the carriage horizontally back and forth across the frame. Second transport means are provided for moving the second support between a first vertical position wherein the carriage and the roller passes over the second support platform and a second vertical position wherein the carriage and the roller passes over the third support platform. Control means are provided for coordinating the operation of the first transport means, the second transport means and the engagement means to cause the engagement means to engage a first ply from the first stack, transport the first ply on the roller, and disengage the first ply on the second stack with the second support in the first position, and to engage a second ply from the first stack, transport the second ply on the roller, and disengage the second ply on the third stack with the second support in the second position.

For a better understanding of the present invention, together with other and further objects, reference is made to the following description, taken in conjunction with the accompanying drawings, and its scope will be pointed out in the appended claims.

DESCRIPTION OF THE INVENTION

Figure 1:
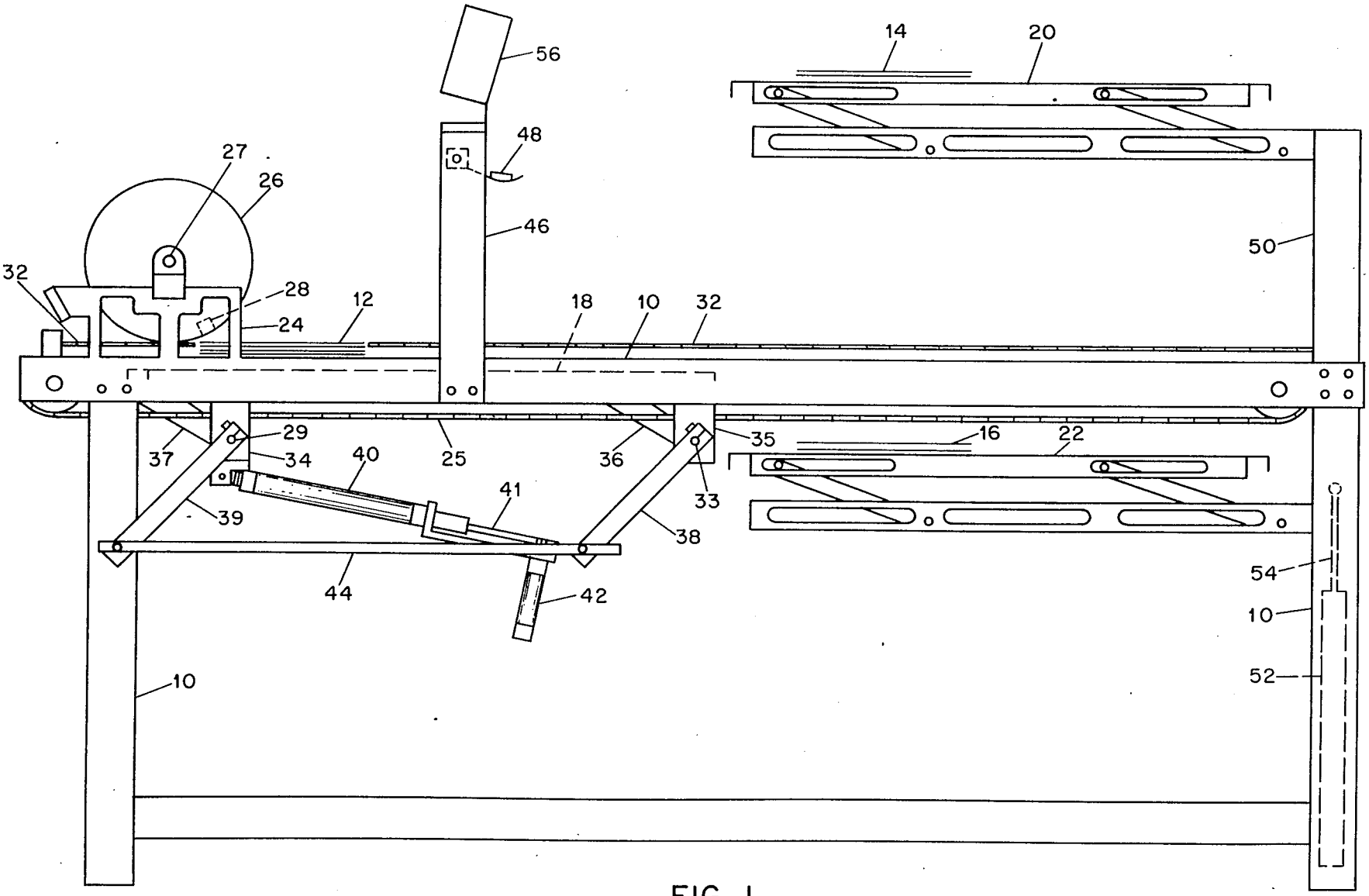
FIG. 1 is a side view of an apparatus in accordance with the present invention.
Figure 2:
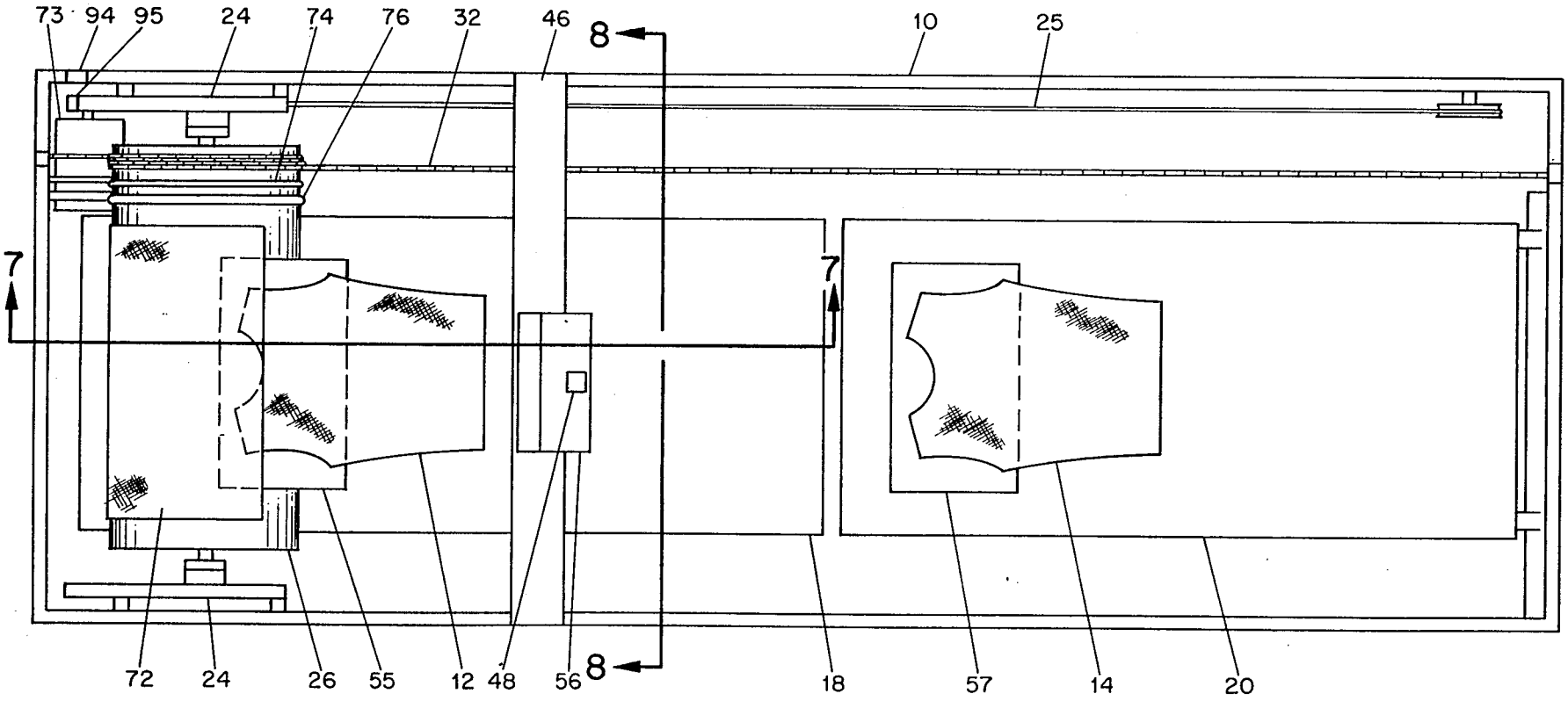
FIG. 2 is a top view of the FIG. 1 apparatus.

Referring generally to FIGS. 1 and 2 there is shown an apparatus in accordance with the present invention for separating single plies of fabric from a stack of fabric plies 12 and sorting alternate layers of fabric into second and third stacks of fabrics 14 and 16. The machine includes a frame 10, which includes horizontal and vertical members in the configuration of an open-top table. The first stack of fabric plies 12 rests on a first support platform 18, which in connection with other members forms a first support. The first support is arranged for vertical motion with respect to frame 10. The second and third stacks of fabric 14 and 16 are respectively held on second and third support platforms 20 and 22, which are mounted to a second support 50. Support 50 is arranged for vertical motion with respect to frame 10. Second support 50 operates as an elevator moving up and down to present support platforms 20 and 22 alternately to receive plies of fabric.

As shown in FIG. 2, platforms 18, 20 and 22 are provided with foam rubber cushions about a half-inch thick covering the portion of the platform supporting about half the stacks 12, 14 and 16. Visible in FIG. 2 are foam cushions 55 and 57 on platforms 18 and 20, respectively.

A carriage 24 is mounted to frame 10 in a fixed position in the vertical direction. Carriage 24 is arranged to move horizontally across the top member of the frame 10 in a back-and-forth motion to the left and right as shown in FIGS. 1 and 2 under the influence of a transport mechanism which includes a driving chain 25 driven by stepper motor 73. Carriage 24 includes a roller 26 pivotally mounted on an axis 27 to the frame of carriage 24. Roller 26 is provided with a cable 32 which wraps around the roller 26, frictionally engaging the roller. Cable 32 has its ends securely fastened to frame 10. Accordingly, as roller 26 is carried back and forth by carriage 24 when driven by chain 25, the roller rolls across the top of the fabric stacks 12, 14 and 16 in a manner whereby the bottom portion of the roller has no net horizontal movement during the rolling. Accordingly, a rolling engagement takes place.

Roller 26 is provided with a fabric engaging means 28 designed to engage the top ply of fabric from stack 12 in order to draw the fabric around roller 26 and thereby transport the fabric onto stack 14 or 16 depending on the position of second support member 50.

Figure 7:
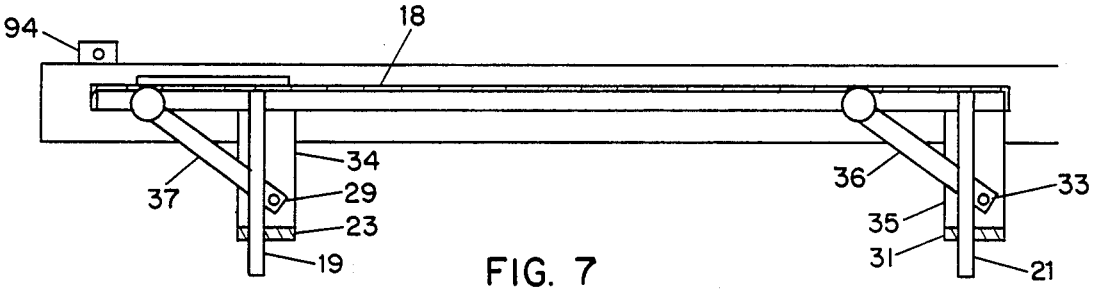
FIG. 7 is a partial longitudinal cross-section of the apparatus of FIGS. 1 and 2.
Figure 8:
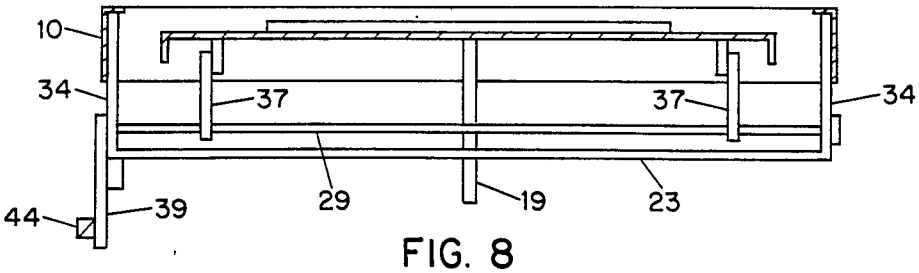
FIG. 8 is a transverse cross-section of the apparatus of FIGS. 1 and 2.

Frame members 34 and 35 are mounted to the horizontal portion of frame 10 and thereby support first support platform 18. Greater detail concerning the support of platform 18 can be seen in the drawings of FIG. 7 and 8, which are vertical cross-section views of the support arrangement. Platform 18 is provided with rods 19 and 21 which pass through horizontal portions 23 and 31 connected to vertical members 34 and 35. Lever arms 36 and 37 are connected to respective axle members 33 and 29. Levers 36 and 37 are provided with roller members at their upper end which engage the underside of platform 18 and support platform 18 in the vertical direction. Axle members 29 and 33 are connected to levers 39 and 38, as illustrated in FIG. 1. Levers 38 and 39 are connected together with tie rod 44 and driven by cylinder 40. Cylinder 40 is supplied with air pressure which urges piston 41 in an inward direction with respect to the cylinder, thereby providing upward pressure on platform 18 through levers 38, 39, 36, and 37. Cylinder 40 is supplied with fluid pressure, such as compressed air, having a controlled amount of pressure to provide a selected amount of upward force on platform 18, for example, in the neighborhood of 5 to 10 pounds upward force. A brake member 42, which is, for example, a compressed air operated brake, is provided to prevent, when engaged, movement of piston 41 under the influence of the supplied air pressure and thereby to lock platform 18 in a fixed position with respect to frame 10.

When roller 26 is in a position which engages fabric stack 12, brake 42 is disengaged and air pressure supplied to cylinder 40 draws piston 41 into cylinder 40, and thereby presses stack 12 upwardly against roller 26. As roller 26 moves out of disengagement with stack 12, brake 42 is engaged so that platform 18 and stack 12 are maintained in a fixed position with respect to frame 10 and consequently a fixed position with respect to roller 26. Similar apparatus for adjusting the levels of platforms 20 and 22 with respect to support member 50 are also provided.

With respect to the platform adjusting mechanism illustrated in FIG. 1 it should be noted that the adjusting mechanism is self-compensating for variations in the weight of the stack of fabric plies 12 on platform 18. When there is a large stack 12 of plies, piston rod 41 is fully extended and exercises maximum leverage on lever arms 38 and 39. This leverage provides an upward force on platform 18 which exceeds the weight of stack 12 by an amount which is sufficient to provide the desired upward pressure against roller 26. When the number of plies on stack 12 is reduced, a lower upward force on platform 18 is required to provide the same pressure against roller 26. The enlarged angle between piston 41 and lever arm 38 results in a reduction of the upward force on platform 18, thus providing self-compensation.

Figure 20:
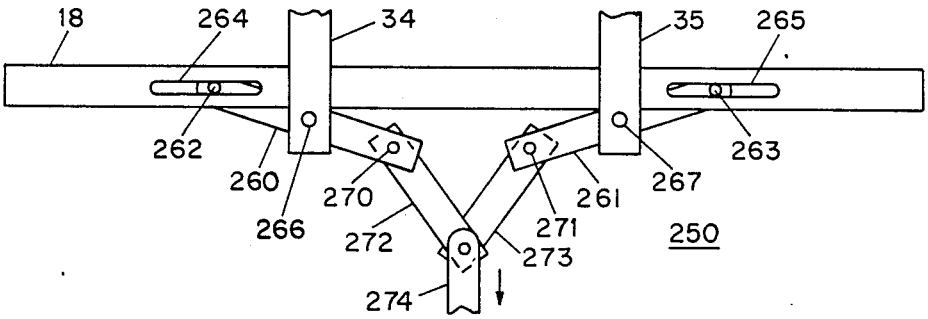
FIG. 20 is a vertical partial view showing an improved arrangement for maintaining substantially constant upward pressure against the roller by the stack of plies despite changes in the number of plies in the stack.

In my later embodiment, alternative arrangement 250, which also provides self-compensation for weight of stack 12, is employed to support platform 18 as shown in FIG. 20, which is a vertical partial view.

Arrangement 250 also is devised to provide an upward pressure on platform 18 which varies directly with the weight of the stack of remaining plies, so that as the stack diminishes, the upward pressure decreases whereby an approximately constant upwards pressure is maintained against the roller by the stack. In particular the support platform 18 is provided with angled lever members 260 and 261 which include members 262, 263 which are free to slide in slots 264, 265, respectively, in a horizontal portion of support 18. The lever members 260, 261 also include, intermediate their ends, axles 266, 267, respectively, which are rigidly tied to the vertical support frame members 34, 35 which are mounted to the horizontal portion of frame 10 (not shown) as in the earlier embodiment shown in FIG. 1. The lower ends 270, 271 of lever members 260, 261 are hinged to the upper ends of the nearly vertical link members 272, 273, respectively, whose lower ends are connected together with the end of the tie rod 274, which is pulled by the piston of an air cylinder (not shown). The cylinder is supplied with fluid pressure, such as compressed air, having a controlled amount of pressure to provide a desired amount of downward force on the tie rod 274. This downward pressure on rod 274 causes upward pressure on platform 18 by way of the tie rod 274, the vertical link members 272, 273 and the lever members 260, 261. As the number of plies in the stack dwindles, there is less opposing downward force on the platform because the weight of the stack is reduced. Hence platform 18 rises higher, the length of the lever provided by lever members 260, 261 is reduced with this shortening of the lever length, a smaller fraction of the pressure provided by the cylinder is exerted upwards on the support platform 18, as is desired to keep esentially constant the pressure between the roller and the stack of plies despite a decrease in stack weight.

The same braking arrangement (not shown) can be employed to keep the desired position of the platform.

Support on the opposite side of platform 18 can be provided by levers connected to axels 266, 267 to provide even support.

Figure 12:
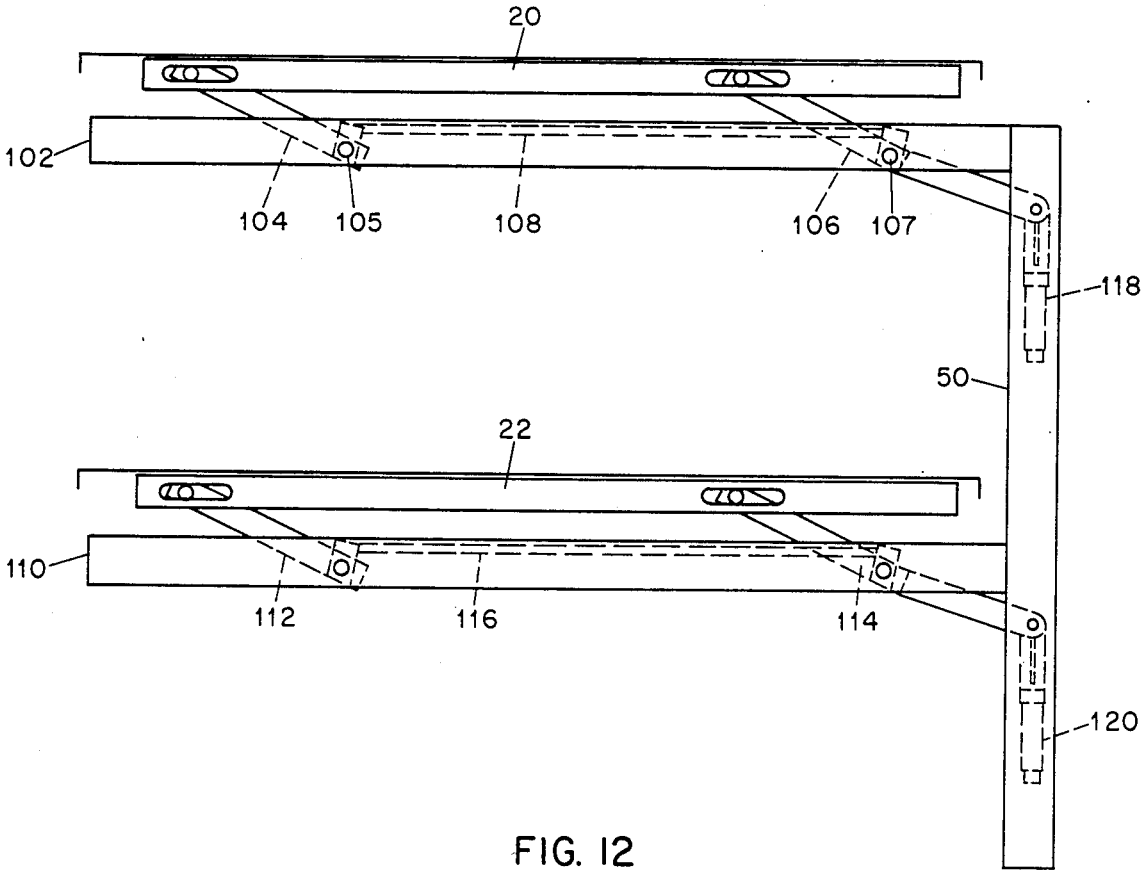
FIG. 12 is a side view of a support adjusting mechanism used in the FIG. 1 apparatus.
Figure 13:
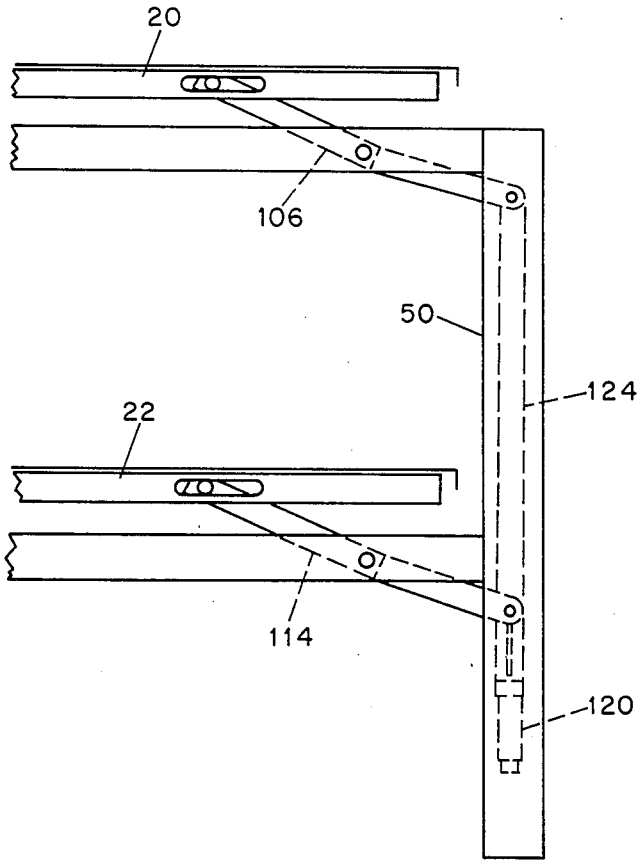
FIG. 13 is a side view of an alternate support adjusting mechanism used in the FIG. 1 apparatus.
Figure 14:
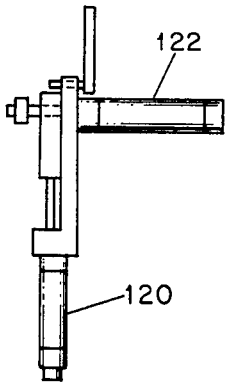
FIG. 14 is an end view of an adjusting cylinder used in the FIG. 13 apparatus.

FIG. 12 shows the details of an adjusting mechanism useable in connection with support platforms 20 and 22 on support 50. Platforms 20 and 22 may be provided with vertical support rods, similar to rods 19 and 21, which permit vertical, but not horizontal, motion with respect to horizontal support members 102 and 110. Vertical support for platform 20 is provided by levers 104 and 106, which are rigidly connected to respective axles 105 and 107. A tie rod 108 connects axles 105 and 107 for uniform rotational motion with respect to support 102. One end of lever 106 is connected to an adjusting piston 118. The arrangement of levers 112, 114, connecting rod 116 and adjusting piston 120 which support platform 22 is similar. FIG. 14 is an end view of cylinder 120, which illustrates its connection to a brake 122. Piston 118 is provided with a similar brake. Pistons 118 and 120, in connection with their associated lever mechanism act to adjust the levers of platforms 20 and 22 when the corresponding brakes are disengaged. The operation is similar to the adjusting mechanism for support platform 18. Thus piston 118 is operative when roller 26 engages a stack on platform 20 and piston 120 is operative when roller 26 engages a stack on platform 22. Since platforms 20 and 22 are receiving plies of fabric, roller 26 forces the platforms down against the supplied, controlled air pressure to achieve a gradual downward adjustment of platforms 20 and 22. FIG. 13 is a partial diagram of support 50, which shows an alternate construction wherein a connecting rod 124 is provided to connect the ends of levers 114 and 106, so that piston 120 can operate both levers, and piston 118 and its associated brake are not required.

An air cylinder 52 having a piston 54 is connected between second support 50 and frame 10. Air pressure supplied to cylinder 52, which is preferably a two-way piston, drives support 50 up and down to alternately present platforms 20 and 22 to receive plies of fabric. A counterweight mounted to frame 10 and support 50 may be provided to achieve smooth operation of support 50.

Mounted on frame 10 is an additional frame member 46 which supports a microprocessor control unit 56 which controls operation of the apparatus. Frame member 46 also provides support for a resilient and pivotable probe member containing a magnetic field sensor 48.

Figure 3:
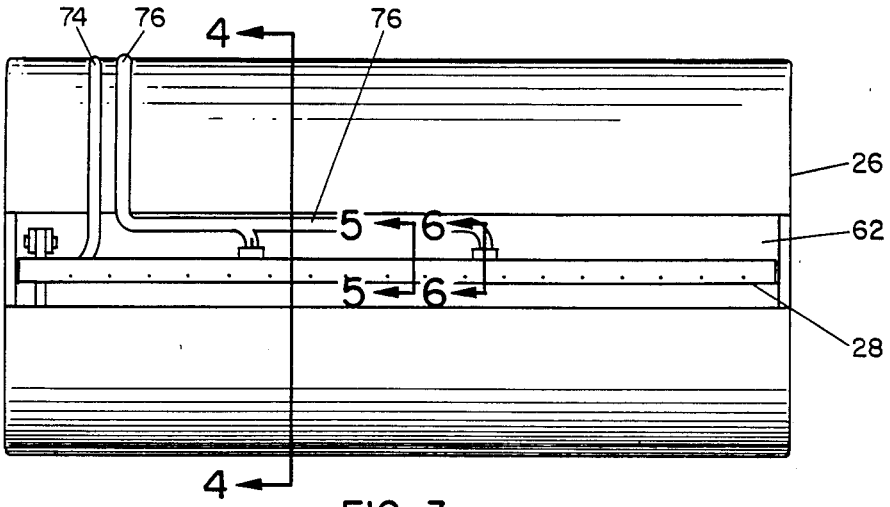
FIG. 3 is a plan view of the roller used in the FIG. 1 apparatus, showing the engagement means.
Figure 5:
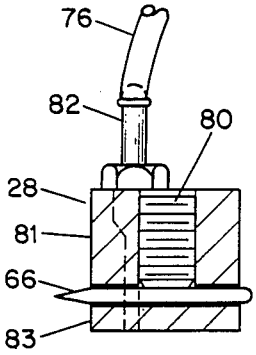
FIG. 5 is a cross-sectional view of the engagement means used in the FIG. 3 roller.
Figure 4:
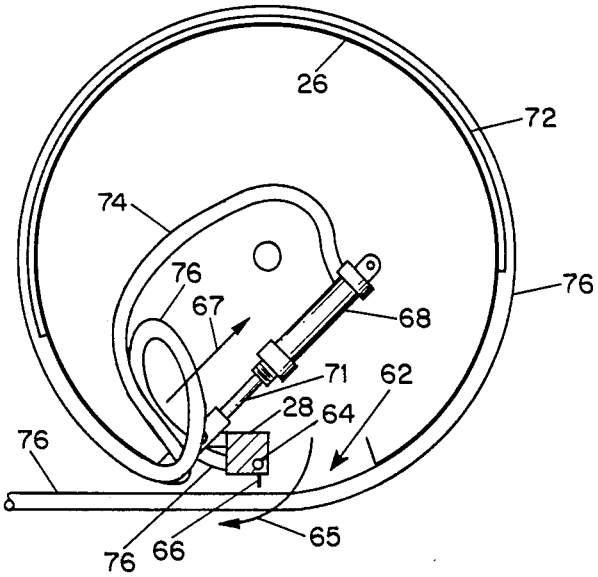
FIG. 4 is a cross-sectional view of the FIG. 3 roller.
Figure 6:
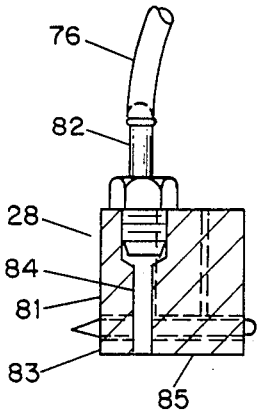
FIG. 6. is another cross-sectional view of the engagement means used in the FIG. 3 roller.

Referring to FIGS. 3 through 6, there are shown further details of the roller 26 which is used in connection with the apparatus of FIG. 1. FIG. 3 is an exterior view of roller 26, showing engaging mechanism 28 which is arranged to engage an end of the top ply of fabric on stack 12. Cross sectional details are shown in FIGS. 4–6. Roller 26 is a hollow cylindrical roller fabricated with an outer roller surface formed of sheet metal. Roller 26 has an opening 62 in the outer roller surface which accommodates fabric engaging mechanism 28. Opening 62 is approximately $2\frac{1}{4}$ inches wide in the direction of the circumference of roller 26. Roller 26 is approximately 9 inches in diameter. Engaging mechanism 28 includes a square cross-section elongated rod, which is pivotable about an axis 64 (FIG. 4) which is in the direction of elongation of the rod and parallel to the axis of cylinder 26. Flat surface 81 of rod 28 is provided with a plurality of pins 66, which protrude from the surface by a distance which is less than the thickness of the cloth which is to be engaged. Preferably the protrusion of pins 66 is in the range of about one-half of the cloth thickness to less than the thickness of the cloth.

Pivot axis 64 of rod 28 is located in the vicinity of the intersection of two flat surfaces 81 and 85 of the rod, which form a right angle edge 83 near pins 66. In one embodiment the axis is approximately $\frac{1}{8}$ inch from surfaces 81 and 85, and pins 66 are located on surface 81 a distance of $\frac{1}{8}$ inch from edge 83. In this case rod 28 is $\frac{1}{2}$ inch square in cross-section.

Roller 26 is provided with an operating mechanism comprising an air cylinder 68 (FIG. 4) which operates under the influence of air or other gas pressure provided over tube 74, which wraps around the periphery of cylinder 26 as it moves along frame 10. When air pressure is provided to cylinder 68, it draws piston rod 71 in the direction indicated by arrow 67, thereby rotating elongated rod 28 in the direction shown by arrow 65. This operation rotates the elongated rod 28 by approximately 90° from a first orientation shown in FIG. 4 to a second orientation, and causes the pins 66 to firmly engage an end of the top ply of the fabric to be drawn onto the roller 26.

FIGS. 4 and 5 are cross-sectional views showing greater details of the elongated rod 28. FIG. 4 shows pins 66, which protrude from the rod by a small amount, usually in the range of 0.025 to 0.030 inches. Pins 66 in one embodiment comprise commercial type B-27 sewing needles. The pins are held to rod 28 by set screws 80. When rod 28 is in a first orientation shown in FIG. 4, pins 66 face radially outward with respect to roller axis 27. Pins 66 approximately intersect the pivoting axis 64 of rod 28.

Figure 11:
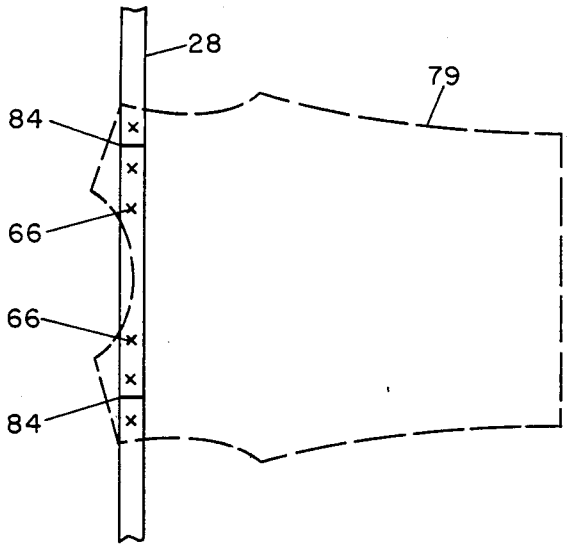
FIG. 11. is a sketch showing the engagement position for the engagement means of the FIG. 1 apparatus.

Rod 28 is also provided with air openings 84, shown in FIG. 6, which are connected by coupling 82 to air supply line 76. Air openings 84 have outlets on second flat surface 85 of rod 28. Surface 85 is the surface which is radially outward from the axis of roller 26 when operating mechanism 68 rotates rod 28 to the second orientation about axis 64. Accordingly, when rod 28 is rotated to the second orientation to engage a fabric ply, air openings 84 and surface 85 face toward the stack of fabric. At this point, an air jet may be supplied over line 76 to blow through the engaged first ply and help separate it from the second and further plies of fabric as roller 26 starts to move with the first ply of fabric engaged by pins 66. FIG. 11 shows in dotted outline a piece of fabric 79 to be engaged, and also shows the elongated rod 28 having six pins 66 (shown as X) to engage fabric 78. The apparatus is preferably arranged as shown in FIG. 11 wherein there are provided three pins 66 which engage each side of one end of the fabric ply 79. There are supplied air openings 84 adjacent each set of three pins where they engage the fabric. The fabric is arranged on platform 18 at a position wherein pins 66 engage the ply about ½ inch from the end of the fabric. It should be recognized that the fabric engaging arrangement illustrated in FIG. 10 is a typical arrangement for one particular pattern of fabric 78, and other arrangements of pins 66 or air openings 84 may be appropriate for different fabric shapes. Likewise, it should be recognized that the extension of pins 66 outward from the flat surface 81 from which they emerge can be adjusted by the use of set screws 80 to correspond to the thickness of the fabric to be engaged.

Figure 16:
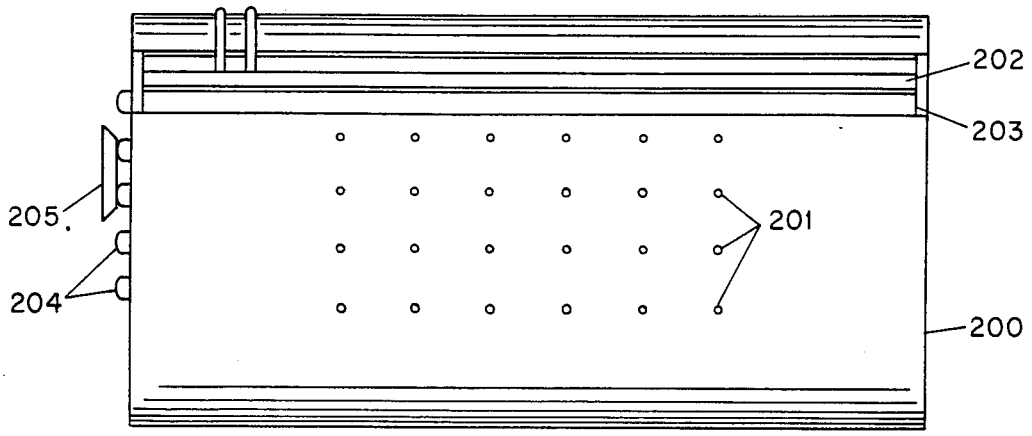
FIG. 16 is a plan view of an improved roller which is provided with air holes to further help in separation of the chosen ply from the stack.

In my improved version shown in FIG. 16, the roller 200 is provided with an additional series of horizontal rows of air holes 201. In the illustrative embodiment depicted, there are four rows, the top three closest to the engaging rod have six holes each, and the lowest has four holes. Typically the top row was spaced ¾ inches from the slot 203 in which sits the engaging rod 202 and the other rows two inches apart. The two middle holes in each row are spaced an inch apart, the others two inches apart.

Figure 9A:
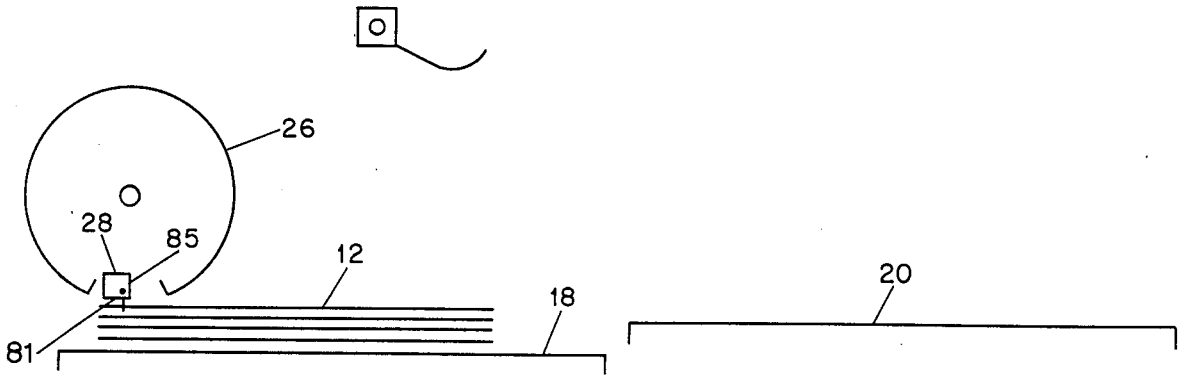
FIGS. 9A and 9B are simplified diagrams illustrating the operation of the FIG. 1 apparatus.
Figure 9A:
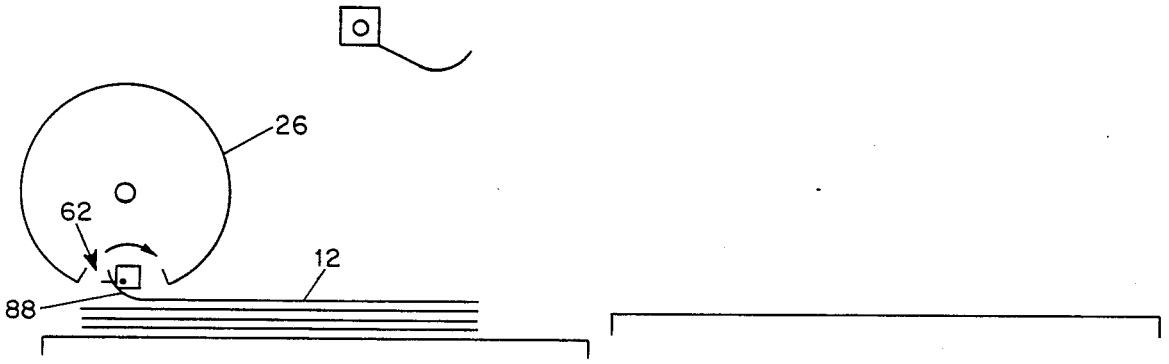
Figure 9A:
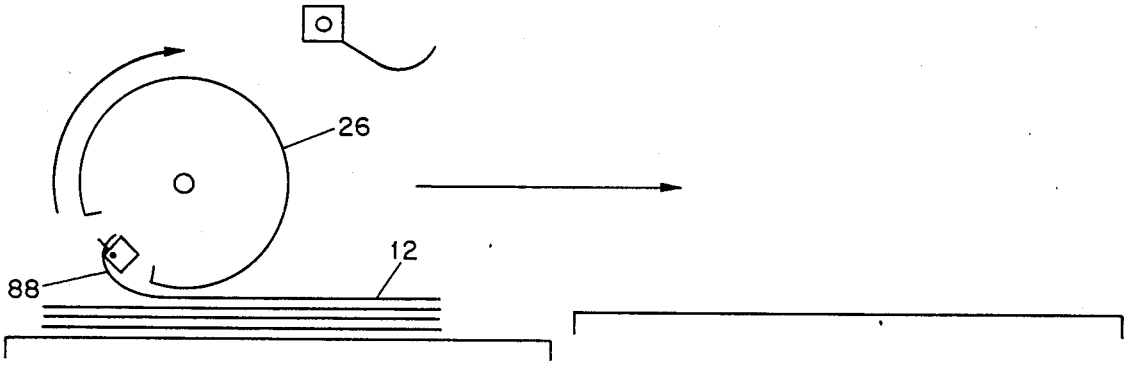
Figure 9A:
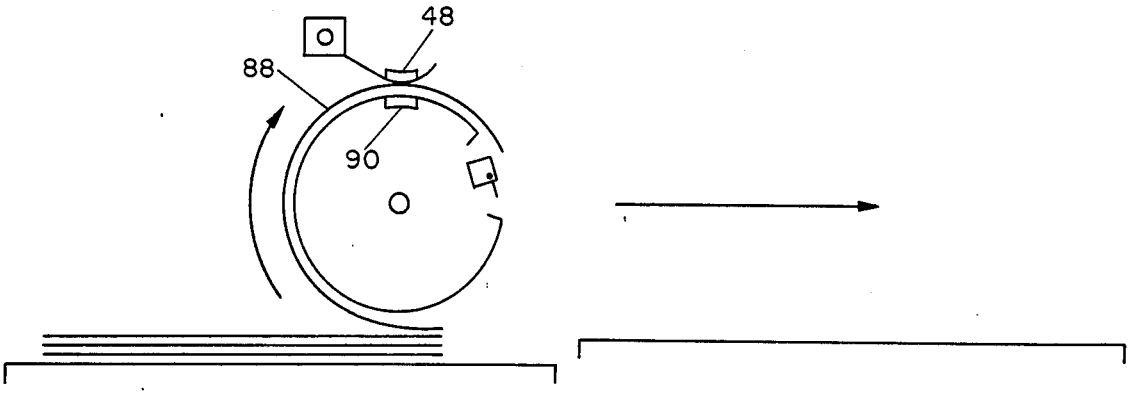
Figure 9B:
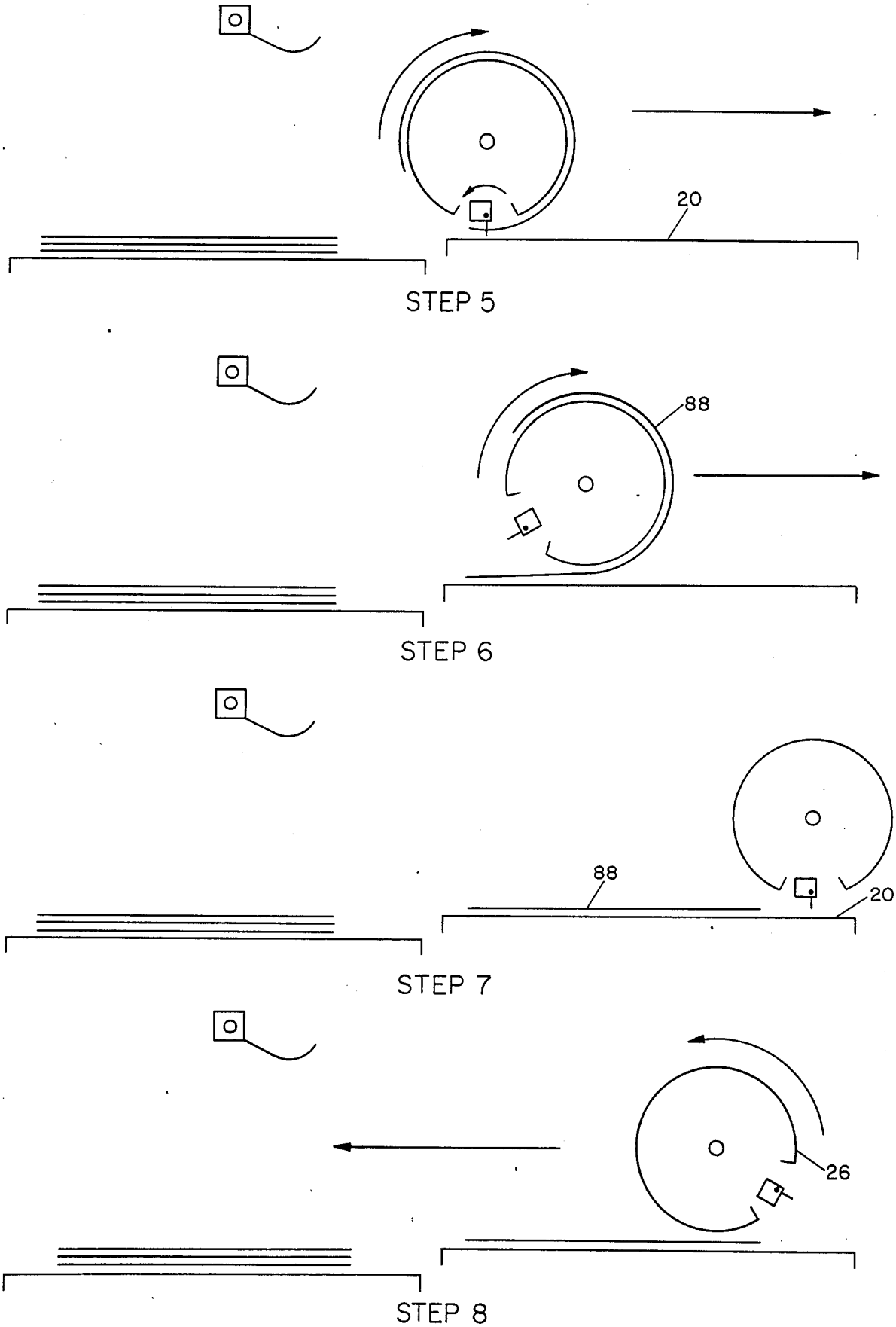
Figure 10A:
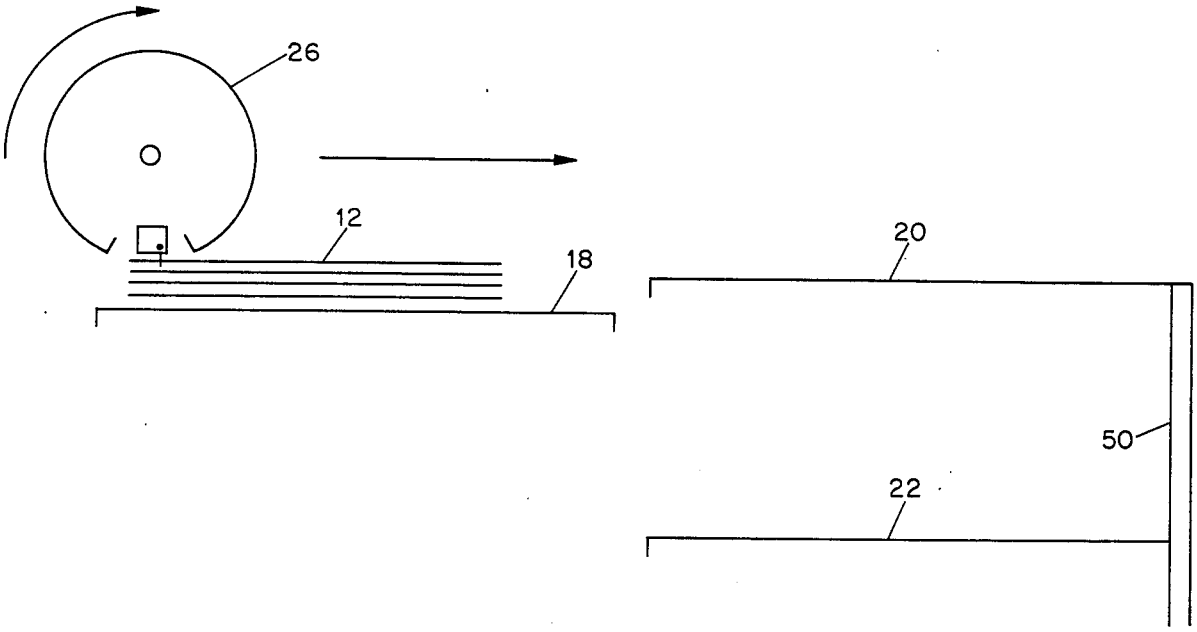
FIGS. 10A and 10B are simplified diagrams illustrating the operation of the FIG. 1 apparatus.
Figure 10A:
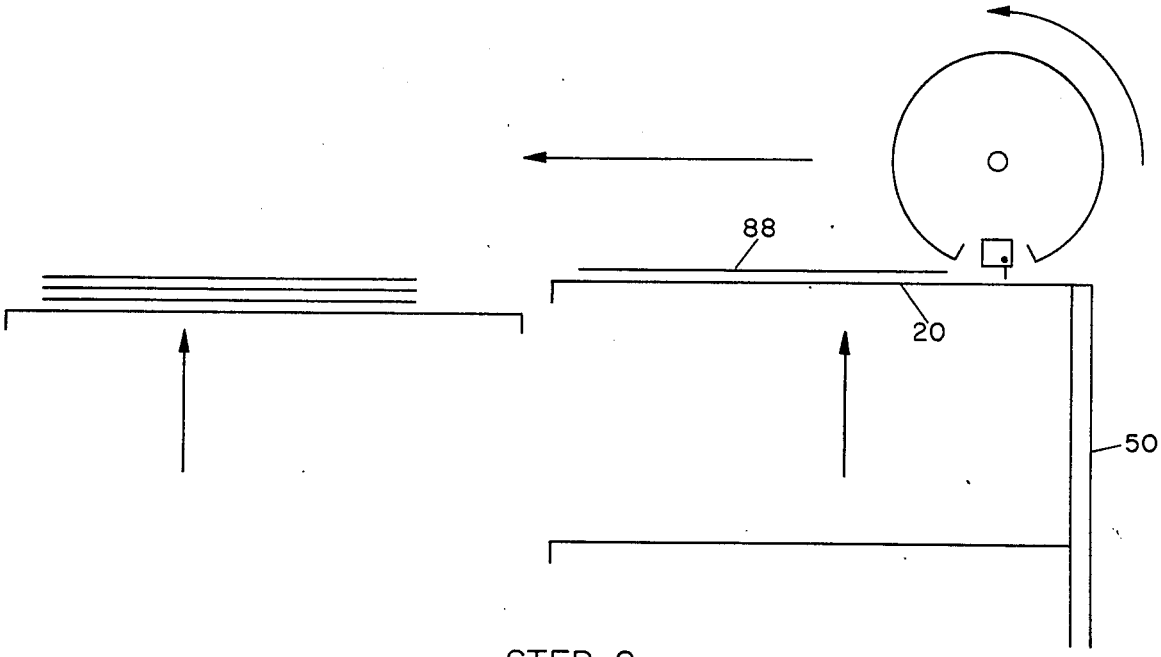
Figure 10B:
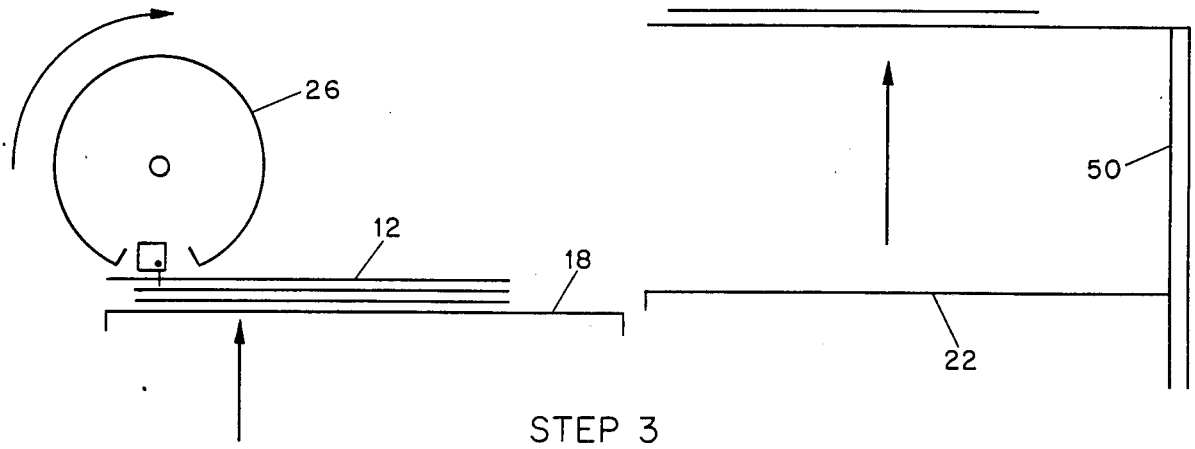
Figure 10B:
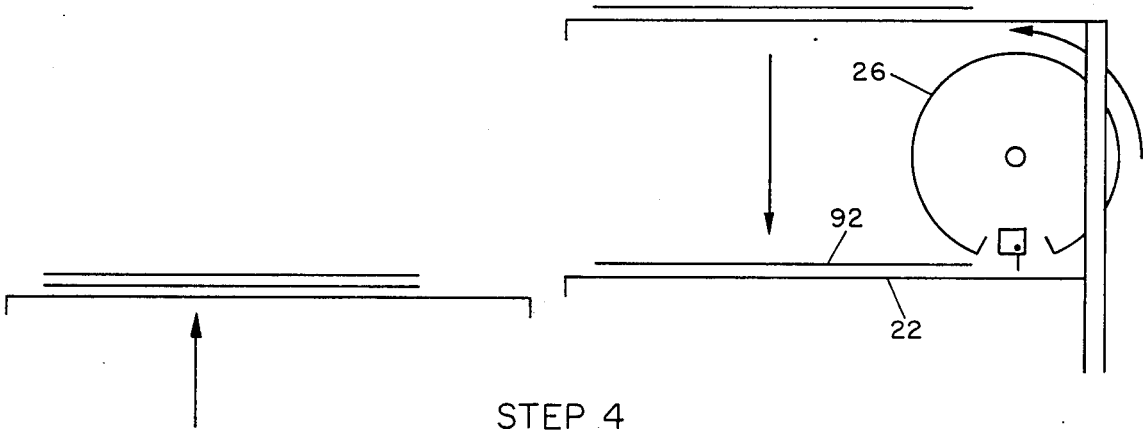
Figure 17:
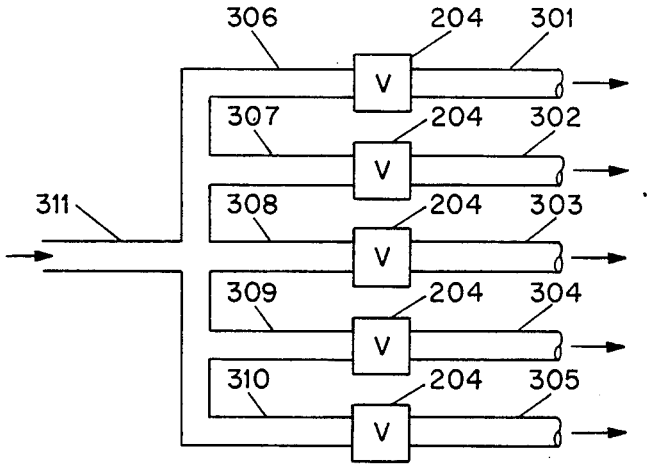
FIG. 17 is a schematic of the air supply to the roller of FIG. 16

Additionally, each row of holes has associated with it its own valve 204 mounted on a side of roller 200 facing operating cam 205. There are provided five such valves, two of which may engage cam 205 at any particular position of roller 200. One of valves 204 is used to supply compressed air bursts to the holes on rod 202, and the remaining valves 204 supply air to rows of holes 201 in sequence as the roller separates from the stack. The valves are shown schematically in FIG. 17 where five valves 204 are shown, one each in a manifold arrangement of five lines 306–310 with a common supply line 311. Line 301 supplies the air holes in the engaging rod. discussed in connection with FIG. 6, and the others supply the air holes in the four rows in the roller shown in FIG. 16. Air is made to flow out of a particular row of air holes just after the portion of the roller corresponding to a particular row of holes has passed the point where it engages the stack of plies so the air flow will help in separating a single chosen ply from the remainder by applying localized downward air pressure on the remainder. This supplements the air flow through the engaging rod when the pins first make contact, which action is described in more detail in connection with FIG. 9A. Advantageously the cam is of sufficient width that two switches can be depressed at a given time, as shown in FIG. 16. This technique permits more reliable separation and faster operation.

FIG. 9 is a series of simplified drawings illustrating the operation of the roller 26 and engagement means 28 in picking plies of fabric from a stack 12 on a first support platform 18 and depositing the fabrics onto a second support platform 20. As illustrated in FIG. 1, at step 1, roller 26 is moved near its left-most position wherein it engages the top of the stack 12 of fabric at the end of the stack away from support platform 20. When the roller 26 is placed into this position, the engagement means 28 has the position illustrated, wherein surface 81 from which pins 66 emerge is facing outward with respect to the axis 27 of roller 26, and thereby engages the top ply of fabric on stack 12. Immediately after this engagement with rod 28 in a first orientation, rod 28 is rotated by 90° about its own axis 64, to a second orientation, shown in step 2 of FIG. 9, wherein the pins 66 are oriented circumferentially with respect to the axis of roller 26 and the surface 85 is facing the top ply of fabric stack 12. When this position is reached, the first ply of fabric 88 is engaged on pins 66 and drawn slightly upward at its edge into the opening 62 of roller 26. In step 3, roller 26 has initiated a rolling motion to the right. Starting with the pivoting of engagement rod 28, as illustrated in step 2, and during the initial movement of roller 26 to the right as illustrated in step 3, air is supplied througn tube 76 to openings 84 on surface 85 of rod 28. The air thus supplied is blown through fabric ply 88 and serves to keep the remaining fabric plies of stack 12 in a flattened condition, so that they do not cling to first ply 88. Moreover, in my improved version, as previously discussed in connection with FIG. 16, additional air is blown through the successive rows of air holes as the roller rolls along to keep the remaining fabric plies of the stack in a flattened condition. As illustrated in step 4, roller 26 continues a rolling motion to the right, and draws the first ply 88 of fabric almost completely around the roller. It will be noted in this step that the circumference of roller 26 is selected to be greater than the length of the fabric ply in the direction of movement of the roller. It should be likewise noted that the circumference of the roller corresponds approximately to the distance between corresponding portions of the first platform 18 and the second platform 20 as will become further evident.

As illustrated in Step 4 of FIG. 9, during the rolling motion to the right, the periphery of roller 26 engages a magnetic field detector 48 which is mounted on a resilient support bearing against roller 26. A permanent magnet 90 is positioned on the periphery of roller 26 at an angular and longitudinal position so that it passes directly beneath magnetic field sensor 48. When the roller reaches this position, the output level of magnetic field sensor 48 is sampled and compared to a threshold level, or a plurality of threshold levels. This sampling is to determine whether the roller has engaged a single ply of fabric 88, has failed to engage a fabric, or has engaged multiple plies of fabric.

In a preferred embodiment, the output level of magnetic field detector 48 is compared to upper and lower threshold levels. The upper threshold level is selected to correspond to a magnetic field which is less than the magnetic field when there is no material on roller 26, and greater than the magnetic field when there is a single ply of material on roller 26. The second threshold level is selected to correspond to a magnetic field which is less than that experienced when there is a single ply but greater than that experienced when there are multiple plies of material on roller 26. Accordingly by sampling the output level of magnetic field detector 48, when the magnetic field source 90 is in a position opposite the magnetic field detector, it is possible to determine whether there is no cloth on roller 26, more than one layer of cloth on roller 26 or a correct condition of a single layer of cloth on roller 26.

In a preferred embodiment, the output level of magnetic field detector 48 is supplied as an analog magnetic field proportional signal to an analog-to-digital converter. The sampled signal, converted to digital format, is supplied to a microprocessor, wherein the sampled value is compared to upper and lower threshold values to determine whether the appropriate single ply of material has been engaged by the roller. In the event of a malfunction, which results in either no material on the roller or a multiple ply of material on the roller, the microprocessor is arranged to discontinue operation of the transport mechanism until an operator can manually reset the machine. The use of a microprocessor in connection with the sampling operation is preferable, since it is possible to adjust both the upper and lower threshold values, according to the thickness of the material being picked up by the roller.

In my improved version, detection is done at two locations, corresponding to the opposite edges of a ply when it is properly supported on the roller. By this expedient, there can be detected undesired folds or misalignment. To this end, the roller is provided with a pair of magnetic field sources spaced apart along the axis approximately the width of the ply. Additionally there is provided a correspondingly spaced pair of magnetic field detectors under which the pair of sources will pass directly as the roller rolls past in the manner described for the single source and detector. Again provision is made for sampling the magnetic field detected when the source and detector are properly aligned.

Figure 18:
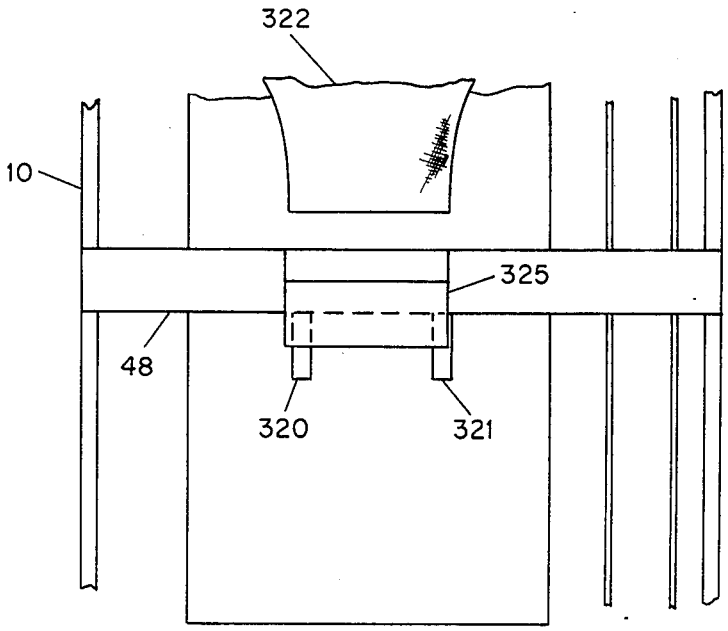
FIG. 18 is plan view of an improved detection system involving detection of the presence or absence of fabric at two locations.

FIG. 18 is a partial top view showing a pair of detectors 320 and 321 supported from the support 48 which is mounted on the frame 10 (as best seen in FIG. 1). These detectors are so spaced that they will pass over opposite edges of the ply 322 as the ply rolls past on the roller. If the ply has a significant fold, it will not extend its full width and so at least one detection will detect an absence of fabric.

Figure 19:
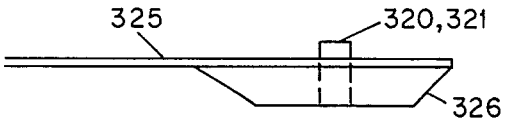
FIG. 19 shows how the detectors are supported in the system of FIG. 18.

FIG. 19 is a partial side view showing an illustrative holder for supporting the detectors 320, 321 from a horizontal member 325 mounted on support 48 (FIG. 18). The holder comprises horizontal member 325 and detector mount 326 which has angled leading and trailing ends. The horizontal member 325 is resilient so that the support provided has the desired resiliency. Each of the two detections would be operated in the manner described above for the single detection except that there would be included an alarm for indicating an inappropriate reading at either of the two detectors.

Step 5 of FIG. 9 shows a further progress of roller 26 to the right at the condition wherein the roller 26 has completed one full revolution. At this point, rod 28 is pivoted from its second orientation back to its first orientation, whereby the pins are again oriented radially outward with respect to the axis of roller 26 so that the ply of material on the roller starts to unroll from the roller to be deposited onto supporting platform 20. Step 6 shows further action as the material is unrolled from roller 26. As illustrated in FIGS. 2 and 4, roller 26 is preferably provided with a cloth covering 72 which covers the outer periphery of roller 26 over approximately half its circumference on the side opposite to the opening 62 containing rod 28. This cloth covering is advantageous in the position shown in step 6 of FIG. 9 because it provides a high friction surface which prevents the ply of material 88 from sliding off the roller at this position, and thereby possibly becoming poorly deposited onto surface 20.

Step 7 of FIG. 9 shows the end of the rightward movement of roller 26 when the ply of material 88 has been completely deposited on receiving platform 20. At this point, the movement of the carriage 24 and roller 26 is reversed to return to the starting position with the rod 28 in the disengaged position with surface 81 facing radially outward with respect to the axis of roller 26.

For maximum versatility it is desirable to be able to handle different widths of plies. To further this end, in the improved version a variable arrangement is used for positioning pins in the engaging rod.

Figure 21:
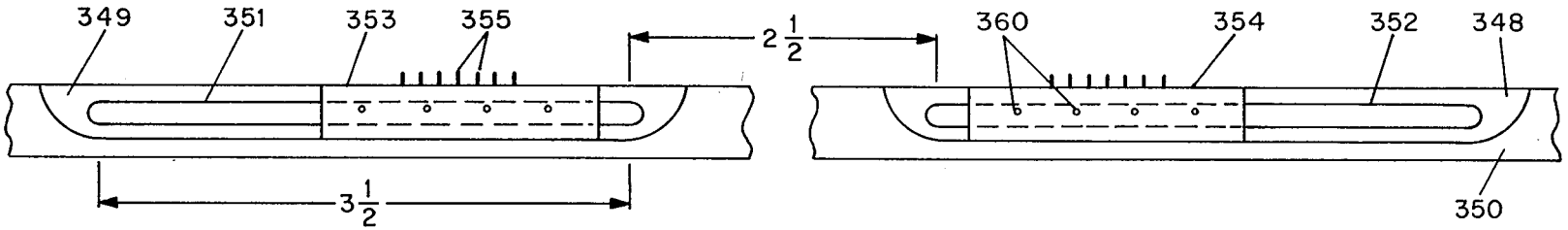
FIGS. 21 and 22 show an improved engaging rod with provision for varying the effective width of the row of pins in the rod.

As shown in FIG. 21, the engaging rod 350 is provided with a pair of slots 351, 352 aligned apart longitudinally. Recesses 348, 349 are provided in the rod along slots 351, 352. Within each recess and slidably mounted to slots 351, 352 is a separate pin holder 353, 354 (shown in more detail in FIG. 22). Each pin holder is shown provided with six pins 355 spaced apart across its width. By sliding the two holders in the slot to vary their separation, the effective width of the row of pins in the engaging rod may be adjusted over a wide range. Generally the position of the two pin holders 353, 354 is adjusted to be slightly less than the width of the plies to be separated.

Figure 22:
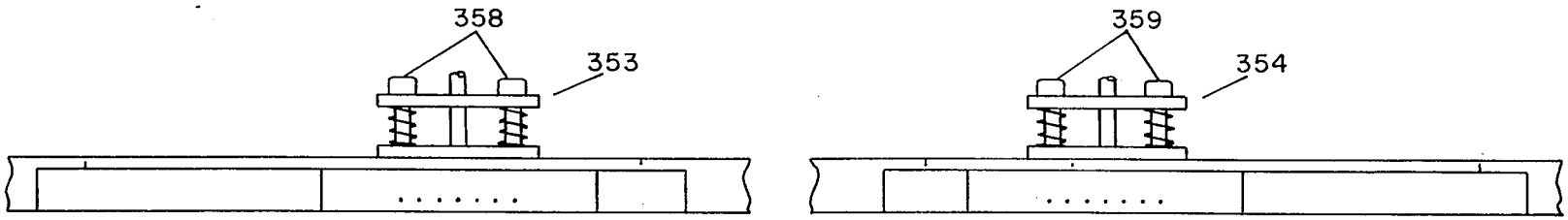

In FIG. 22 there is shown a view in which the rod 350 has been rotated with respect to the view of FIG. 21 to better show the pin holders 353, 354. Each holder uses a pair of spring loaded screws 358 which hold the pin holders to the slots 351, 352. Each holder is also provided with an air inlet 359 by which is supplied air for outlets 360 to help separate the chosen ply from the remainder as previously discussed.

Pins 355 may be mounted in holders 353, 354 by press fit or by using set screws as shown in FIG. 5.

Referring to FIG. 1, it should be noted that the apparatus illustrated is provided with second and third supporting platforms 20 and 22 which are arranged to receive alternate layers of material from stack 12 to form stacks 14 and 16. The operation of the device in this respect makes use of cylinder 52 which has piston rod 54 engaging vertical support 50 which is connected in supporting relationship to second and third platforms 20 and 22. FIG. 10 is a simplified diagram illustrating the operation of the apparatus of FIG. 1 to form second and third stacks 14 and 16 on platforms 20 and 22. In this regard, the apparatus operates similar to the operation illustrated in FIG. 9, with additional operation provided by piston 52 to move support member 50 up and down to form the two stacks. In step 1 of FIG. 10, the roller 26 engages the top ply from stack 12 as it begins its motion to the right. As shown in step 2 of FIG. 9, roller 26 has completed its motion to the right depositing a single ply 88 of the fabric onto platform 20 to start the formation of stack 14. In step 3 of FIG. 9, roller 26 is beginning a second half of its operating cycle and engaging the second ply of stack 12. Meanwhile, support member 50 has moved upward in a vertical direction in order to align suport platform 22 with the path of roller 26. As shown in step 4 of FIG. 9, roller 26 has deposited the second ply of material 92 onto support platform 22 in order to initiate a formation of the third stack 16.

It should be noted that during the back and forth motion of roller 26, there may be provided an adjustment of the height of platform 18 while the roller engages stack 12 and adjustment of the height of platforms 20 and 22 while the roller 26 engages stacks 14 and 16 on these platforms.

As previously mentioned, the apparatus of the present invention may be advantageously controlled in order to coordinate its various operations through the use of a programmed microprocessor contained in control unit 56. In this respect, the microprocessor routine may be initiated by a position signal which corresponds to the left-most position of carriage 24 carrying roller 26. This left most position can be detected by the use of a magnetic field sensing unit 94, shown in FIG. 2, which senses a magnetic field source 95 carried by carriage 24. The sensing of carriage 24 by sensor 94 can initiate a cycle to operate stepper motor 73 to drive carriage 24 by chain 26; to operate piston 52; to operate the brakes 42, 122 on pistons 40, 118, 120; to sample magnetic field sensor 48; to supply air to operate the operating piston 68 within roller 26 and to supply air to openings 84 in rod 28.

Starting from the left most position of carriage 24 with roller 26, which is sensed by magnetic field sensor 94 mounted on frame 10, the microprocessor provides a control signal to rotate elongated rod 28 from a first orientation with surface 81 facing radially outward with respect to the axis of roller 26 to a second orientation wherein surface 85 faces radially outward. At the same time microprocessor 56 provides a control signal which operates a valve to start an air flow through conduit 76 providing an air jet through openings 84. The provision of air through openings 84 will continue for a selected time after the initiation of movement of roller 26 to the right following rotation of rod 28, for example, during the first 20 to 45 degrees of rotation of roller 26. Roller 26 starts moving to the right immediately following the rotation of bar 28. In one embodiment, the roller moves under the control of a stepper motor 73 connected to drive chain 25 so that the motion of roller 26 with carriage 24 is precisely controlled by the microprocessor. After a selected amount of movement the supply of air through conduit 76 to openings 84 is discontinued. After a further time, when the roller has reached a position shown as step 4 in FIG. 9, the microprocessor provides a control signal to sample the output of magnetic field sensor 48. By operating on the sampled output, the microprocesor decides whether roller 26 has properly engaged a single ply of material or has improperly engaged either no ply of material or more than one ply of material. In the event of improper operation or if the stack 12 has been completely depleted, the machine is automatically stopped by the microprocessor for further attention by the machine operator.

Assuming correct operation of the machine, engaging a single ply of fabric, the microprocessor continues to move carriage 24 and roller 26 to the right until it reaches the position shown in step 5 of FIG. 9. In this position, the microprocessor provides a signal to pivot rod 28 back to the first orientation to release the end of the fabric ply which is wrapped around the roller. The roller continues its motion to the right until it reaches the far right end of platform 20 and has completely unrolled the single ply of material on the platform 20. The microprocessor then reverses operation of stepper motor 73, returning the roller to the starting position and, after the roller is clear of platform 20 supplies a signal to provide air to cylinder 52 to operate piston rod 54 to raise support 50 to a position where third platform 22 is adjacent the path of carriage 24 and roller 26. When roller 26 and carriage 24 reach the left most position, again sensed by magnetic field detector 94, the microprocessor again starts its motion to the right causing the rod to engage a second layer of fabric, the air jets operates at a proper time and the magnetic field sensing device checks that proper engagement of the second single layer of fabric has occurred. The roller 26 moves across the top of frame 10 and over platform 22, which by this time is in the proper position and discharges the second layer of fabric onto the now formed stack 16.

During the time that roller 26 engages the top of stack 12, the microprocessor also supplies a signal to brake 42 to disengage the brake and allow platform 18 to be moved upward on the influence of air pressure supplied to cylinder 40. Likewise, when roller 26 is engaging stack 14 or 16 on platforms 20 and 22, similar adjustment may be provided.

Figure 15A:
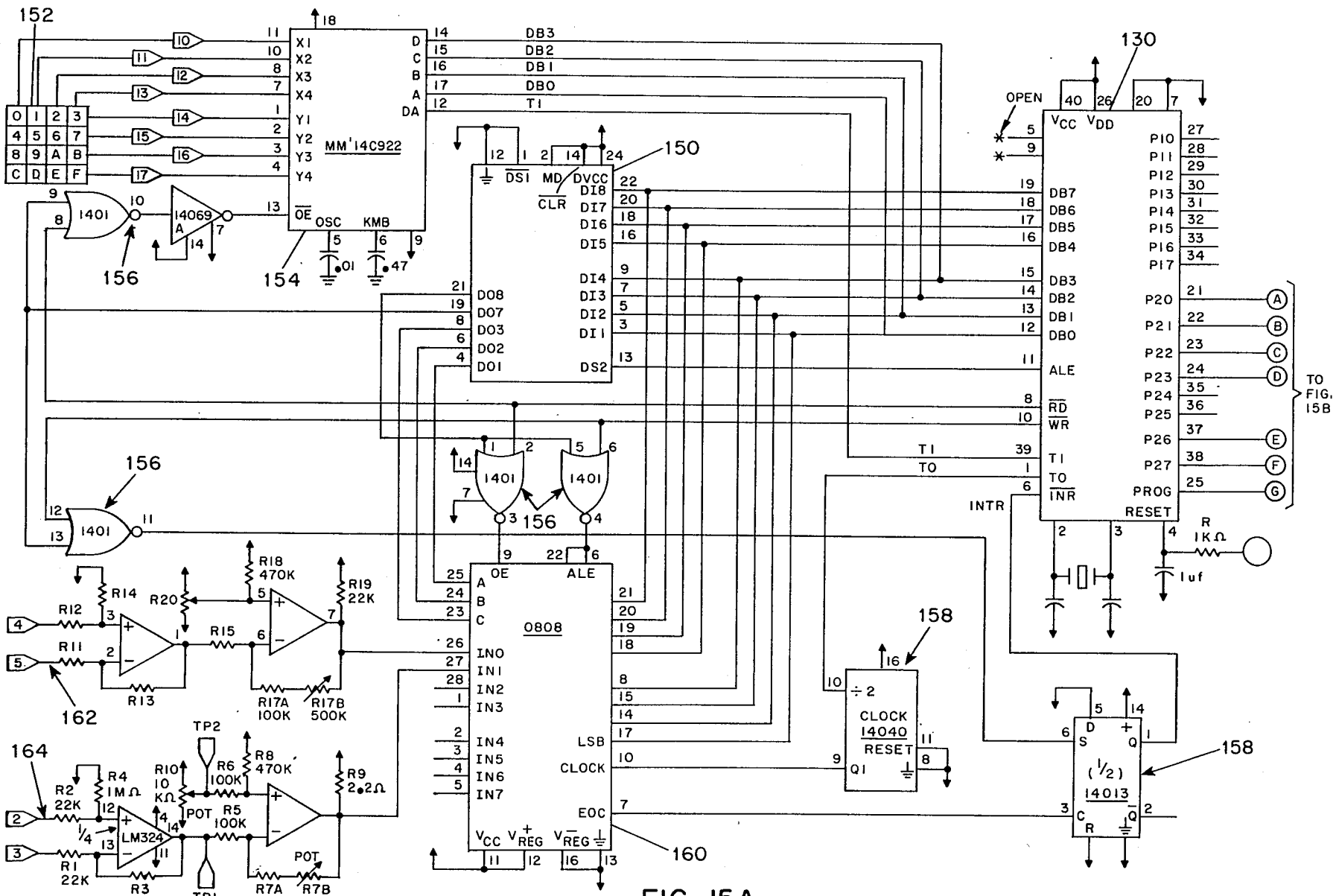
FIGS. 15A and 15B are schematic diagrams of a control circuit for the FIG. 1 apparatus.
Figure 15B:
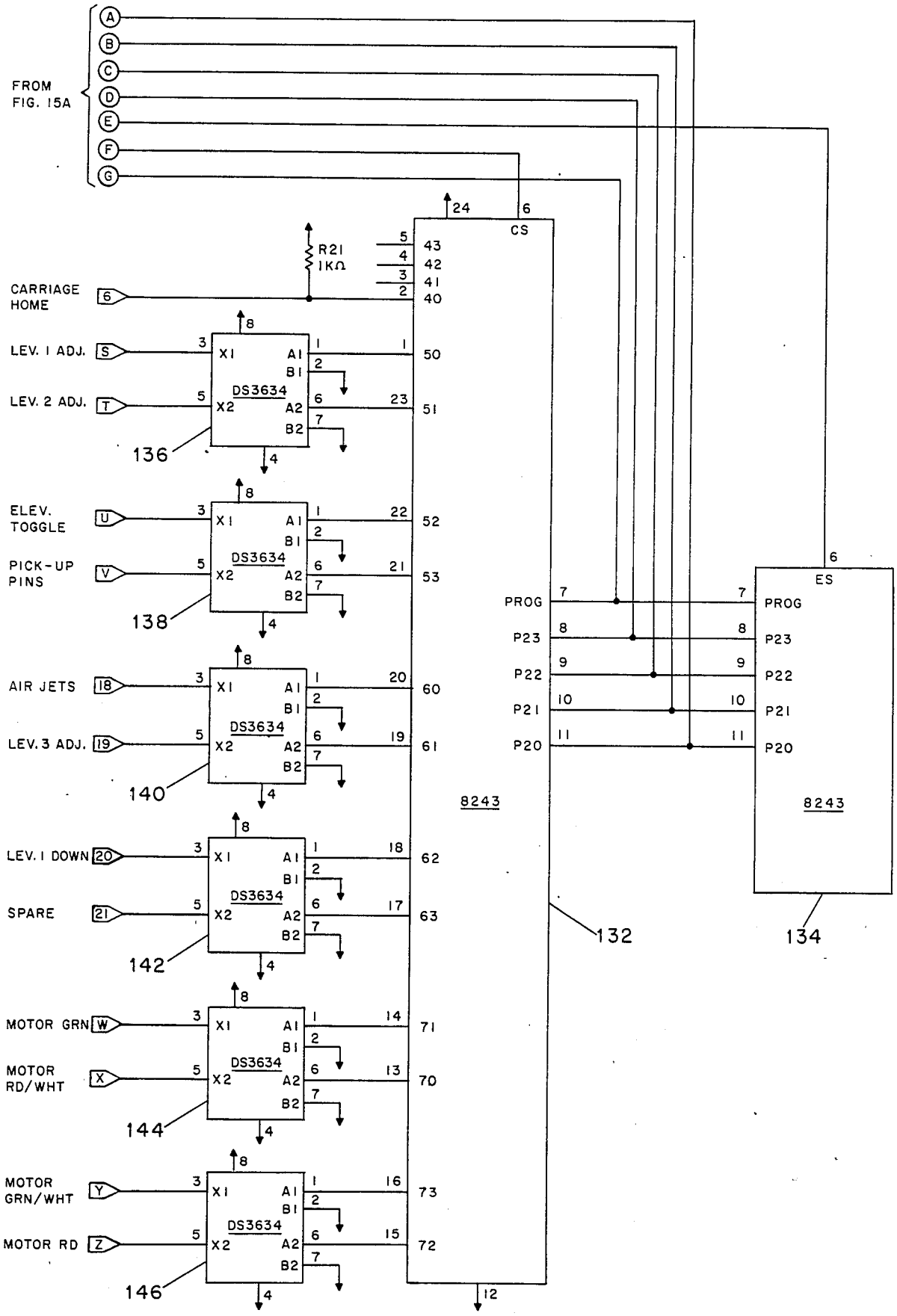

FIG. 15 is a circuit diagram showing the control circuit for operation of the apparatus shown in FIG. 1. The control circuit makes use of a single chip microcomputer 130, which is an Intel MCS-48 microcomputer. The microcomputer 130 is provided with output port expanders 132 and 134 which are Intel integrated circuits type 8243. Output part expander 134 is not used in the arrangement shown. Output port expander 132 has output terminals connected to output buffers 136, 138, 140, 142, 144 and 146. These output buffers provides signals to the various operating components of the system. For example, output buffer 140 provides outputs which operate solenoid valves to supply air to air jets 84 on engagement rod 28. The other output of buffer 140 operates the adjustment mechanism for the third support platform 24, for example, by operating a pneumatic controlled valve which supplies compressed air to brake 122. The additional outputs of the remaining buffers 136, 138 and 142 perform similar functions, including an initial downward motion of platforms 18 for the purpose of loading the platform, adjustment of platforms 18 and 20, operation of piston 52 and operating piston 68. Output buffers 144 and 146 supply pulse signals to control the operation of stepper motor 73. Output port expander 132 has an additional output from pin 40 which provides an indication that carriage 24 is in its home position with magnetic field source 95 adjacent magnetic field sensor 94.

Microcomputer 130 is also provided with an output buffer 150 comprising integrated circuit type 8212, which is used to hold output commands for the magnetic field sampling operation. Gates 156 and flip-flops 158 also aid in this control function. Also provided is an analog-to-digital converter 160, integrated circuit type 0808, which has addressable inputs. This integrated circuit is connected to input amplifiers 162 and 164, which sample the magnetic field sensed by detectors 48 and 94. Control of the microprocessor, for example, to adjust the range of thickness corresponding to a single fabric ply or to lower platform 18 for initial loading, is effected by the use of key pad 152, which is connected to input buffer 154.

Filed with my earlier application Ser. No. 492,721, filed May 11, 1983 is a microfiche appendix, which sets forth a suitable microprocessor control program for use with the MCS-48 microcomputer and the circuit of FIG. 15.

While there has been described what is believed to be the preferred embodiment of the present invention, those skilled in the art will recognized that other and further modifications may be made thereto without departing from the spirit of the invention, and it is intended to claim all such changes and modifications as fall within the true scope of the invention.

I claim:

1. In apparatus for removing a single ply of fabric from a stack of fabric piles by transport on a roller, an arrangement for detecting the satisfactory transport on the roller of a single ply comprising a pair of magnetic field sources spaced apart across the roller a distance corresponding esentially to the width of a single ply and a pair of magnetic field detectors positioned in the path of the roller for engagement by the roller when it is transporting a ply and so spaced that a different one of the two magnetic field sources passes a different one of the two magnetic field detectors.

2. An arrangement in accordance with claim 1 in which the magnetic sources are included in the inside of the roller and the magnetic detectors are suspended from a resilient support in the path of the roller for passage closely thereunder of the magnetic sources as the roller passes under the resilient support.

3. A method for detecting the presence of a fold in a ply which is being transported by passing the ply between a pair of localized magnetic field regions spaced apart essentially the full width of the ply in the absence of a fold so that opposite edges of the fold-free ply will pass through the separate field regions and detecting the magnetic field in the two regions as the ply passes.

4. In apparatus for removing a single ply of fabric from a stack of fabric plies by transport on a roller, a roller supporting an engaging rod provided with a row of engaging pins extending axially across a surface portion of the roller, the roller further including a series of rows of holes spaced circumferentially with respect to the roller axis, each row including a plurality of axially spaced holes, each adapted for blowing air outwardly from the roller, and means for controlling air flow out of said holes for a given period of time in synchronism with the rolling of the roller to help separate a selected ply from the remainder of the stack of plies.

5. The apparatus of claim 4 in which the roller is provided with at least four rows of holes.

6. In apparatus according to claim 4, the means for controlling air flow comprising a series of valves one associated with each row of air holes, and a member for controlling the state of each valve which is engaged as the roller rolls past to provide for the blowing of air out of the roller selectively only when the roller is at preset positions as it rolls across the stack.

7. A method for removing only a single ply of fabric from a stack of fabric plies which comprises passing a roller over the stack for pickup of one end of a single ply by a row of engaging pins supported along the roller, blowing air out of the roller shortly after engagement for separating the engaged ply from the remainder of the stack, and continuing to blow air out of the roller as the roller rolls along the stack locally at the region the roller contacts the stack.

8. In apparatus for removing a single ply of fabric from a stack of fabric plies employing a roller for transport of the single ply, an engaging rod for support by the roller for picking up the single ply which is provided with a pair of slots spaced apart longitudinally and a separate holder mounted to each slot and carrying a plurality of pins, the width of the holder being less than the width of the slot, the holder being slidable in the slot for varying the spacing between the two pin holders and the effective width of the row of pins formed by the pins in the two holders.

9. In apparatus for operating on a stack of fabric plies on a platform moveably mounted to a frame, an arrangement for providing substantially equal upward pressure for adjustment of the platform height as the number of plies on said platform changes comprising a pair of vertical members spaced apart and rigidly mounted to the frame, a pair of lever arms each supported separately at an intermediate point along its length by a different one of the vertical members and free to rotate about such point, the upper end of each lever arm being arranged to vertically support said platform, the lower end of each lever arm being coupled to the upper end of a different one of a pair of link members, and the lower end of each of the two link members being coupled together, and means coupled to the two lower ends of the link members for applying a controllable steady downward force on the lower ends of the link members for maintaining a desired upward force on the platform.

10. Apparatus for removing a single ply of fabric from a stack of fabric plies, comprising:

a frame, a first supporting platform for holding said stack of plies, movably coupled to the frame, a second platform for receiving the separated ply spaced apart horizontally from the first platform, a cylindrical roller having an axis arranged for rolling motion over the first and second surfaces, said roller having an outer roller surface including a longitudinal opening, an elongated rod mounted said roller opening, said roller opening, said rod including a pair of slots spaced apart longitudinally, a separate holder in each slots and slidable therealong for varying the spacing between the two holders, each holder supporting a row of engaging pins protruding from the rod, for contacting the topmost ply when the roller is on the stack of plies, operating means interconnecting said rod and said roller for pivoting said rod about the rod axis, control means for coordinating operation of said roller and said operating means to cause the operating means to coordinate the rotation of the rod for having the engaging pins contact the top ply for picking it up and then changing the rotation, the engaging rod being provided with a longitudinal row of openings and the roller being provided with series of rows spaced circumferentially around the roller axis, each row including a plurality of holes spaced longitudinally, control means for coordinating the blowing of air out of the holes at the position of the roller on the stack of plies as it rolls across the stack, the blowing being adapted to provide downward pressure on the remainder of the stack as the single ply engaged by the engaging pins is lifted away from the stack as the roller rolls along the stack, means in the path of the roller as it moves between the first and second platforms for establishing and detecting a magnetic field at two regions spaced apart longitudinally the width of the ply being transported in the absence of folds and corresponding to two opposite edges of the ply on the roller, and means for maintaining an essentially constant upward pressure on the roller while it engages the stack of plies despite changes in the size of the stack comprising a pair of spaced vertical members each rigidly mounted to the frame, a pair of lever arms each supported separately at an intermediate point along its length by a different one of the vertical members and free to rotate about such point, the upper end of each lever arm being supported within a different one of a pair of substantially horizontal slots spaced apart along the first supporting platform and free to slide within its slot, the lower end of each lever arm being coupled to the upper end of a different one of a pair of link members, and the upper end of each of the link members being coupled together, and means coupled to the two lower ends of the link members for applying a controllable steady downward force on the lower ends of the link members for maintaining a desired upward force on the platform.

* * * * *

UNITED STATES PATENT AND TRADEMARK OFFICE

CERTIFICATE OF CORRECTION

PATENT NO. : 4,690,393

DATED : September 1, 1987

INVENTOR(S) : Elbert Engle

It is certified that error appears in the above-identified patent and that said Letters Patent is hereby corrected as shown below:

Col. 1, lines 67 and 68, "piles" should read --plies--:
Col. 2, line 26, "pins" should read --pin--;

Column 2, line 30, "pins" should read --pin--.

Col. 2, line 33, delete "when";
Col. 3, line 1, "piles" should read --plies--;
line 65, "piles" should read --plies--;
Col. 6, line 39, "disengagement" should read --engagement--;
Col. 7, line 37, "axels" should read --axles--;
Col. 14, line 8, "jets operates" should read --jets operate--;
lines 31-32, "provides" should read --provide--;
Col. 15, line 10, "piles" should read --plies--;
Col. 16, lines 36-37, "mounted said roller opening, said roller opening," should read --mounted in said roller opening--;
line 39, "slots" should read --slot--.

Signed and Sealed this

Fifteenth Day of March, 1988

*Attest:*

*Attesting Officer*

DONALD J. QUIGG

*Commissioner of Patents and Trademarks*